US006276092B1

(12) United States Patent
Neo

(10) Patent No.: US 6,276,092 B1
(45) Date of Patent: Aug. 21, 2001

(54) COMBINED SLIDING AND PIVOT WINDOW ASSEMBLY

(76) Inventor: Ser Lee Neo, Blk 662 Buffalo Road #11-15, Singapore 210662 (SI)

( * ) Notice: Subject to any disclaimer, the term of this patent is extended or adjusted under 35 U.S.C. 154(b) by 0 days.

(21) Appl. No.: 09/592,431

(22) Filed: Jun. 12, 2000

(51) Int. Cl.[7] ..... E05D 15/22

(52) U.S. Cl. ..... 49/183; 49/125; 49/176; 49/177; 49/449

(58) Field of Search ..... 49/176, 177, 178, 49/180, 181, 183, 184, 185, 125, 449, 450, 451

(56) References Cited

U.S. PATENT DOCUMENTS

| | | | | |
|---|---|---|---|---|
| 2,253,325 | * | 8/1941 | Davidson | 49/178 X |
| 4,083,148 | * | 4/1978 | Saucier | 49/125 |
| 4,438,594 | * | 3/1984 | Bunzl | 49/177 |
| 5,058,321 | * | 10/1991 | Harbom et al. | 49/177 |
| 5,065,544 | * | 11/1991 | Martin | 49/177 |
| 5,409,749 | * | 4/1995 | Goldenberg | 49/178 |
| 5,486,026 | * | 1/1996 | Borgardt | 49/180 X |

* cited by examiner

*Primary Examiner*—Jerry Redman
(74) *Attorney, Agent, or Firm*—Dougherty & Troxell

(57) ABSTRACT

A combined sliding and pivot window assembly including a plurality of sashes separately pivotally mounted on substantially C-shaped sash support frames that are slidably fixed on rails provided on an outer window frame. The window assembly includes combined sliding and locking mechanisms that allow the C-shaped sash support frames to slide on the rails when the sashes are pivotally closed, or to be locked on the rails when the sashes are pivotally opened, or to be pushed to one side in the outer window frame while allowing all the sashes to be pivotally opened; pivot mechanisms that allow the sashes to be pivotally opened and stay at any desired open position relative to the sash support frames; and elastic two-end locking mechanisms that are mounted in a vertical member of the sashes to lock the sashes at upper and lower ends to the sash support frames simply by laterally shifting an external adjusting key of the two-end locking mechanism. The combined sliding and pivot window assembly is therefore safer and more convenient for use.

4 Claims, 12 Drawing Sheets

COMBINED SLIDING AND PIVOT WINDOW ASSEMBLY

BACKGROUND OF THE INVENTION

The present invention relates to a combined sliding and pivot window assembly, and more particularly to a window structure that includes pivot mechanisms for a plurality of sashes to be pivotally opened and stay at any desired position relative to sash support frames holding the windows, and combined sliding and locking mechanisms for the sash support frames to slide on rails when the windows are pivotally closed, or to be locked on rails when the windows are pivotally opened, and elastic two-end locking mechanisms for locking the windows at upper and lower ends to the sash support frames simply by laterally shifting an external adjusting key of the locking mechanism. According to the present invention, each of the sash support frames is a substantially C-shaped member, whereby when all the sash support frames are pushed to one side of an outer window frame in which the sash support frames are slidably mounted, all the sashes in the sash support frames could be pivotally open at the same time.

Most window structures in the early stage are either a sliding window that includes sashes slidably mounted on rails in an outer window frame, or a pivot window that includes sashes connected at one side to an outer window frame through pivotal shafts so that the sashes may be pivotally opened or closed. Problems with the sliding window include that when the sashes thereof are slid opened, the sashes overlap to occupy and block about one half of the window space, and that it is uneasy to clean outer side of the window. And, a problem with the pivot window is that the sashes are pivotally connected to fixed positions on the window frame and will sometimes block the sight of people. To solve these problems, there are combined sliding and pivot window structures developed in recent years through different technical means and structural designs.

U.S. Pat. No. 4,222,201 entitled "Sliding pivoting Window" allowed in 1980, U.S. Pat. No. 4,337,597 entitled "Sliding Window Construction Having pivotal Characteristic to Facilitate Cleaning both Sides of The Window" allowed in 1982, U.S. Pat. No. 4,682,455 entitled "Sliding Window Construction" allowed in 1987, U.S. Pat. No. 4,559,739 entitled "Stabilized pivotable Window" allowed in 1985, U.S. Pat. No. 4,592,168 entitled "Sliding and pivotal Window" allowed in 1986, U.S. Pat. No. 4,802,307 entitled "Tilt-sliding Mechanism for A Window or Door" allowed in 1989, U.S. Pat. No. 4,922,657 entitled "Locking Slide for Tilt-out Window Balance System" allowed in 1990, and U.S. Pat. No. 5,065,544 entitled "Window Assembly" allowed in 1991; European patent Application publication Nos. 0222092, 0223068, 0297202B1, 0312738B1, and 0507592A1; and PCT Patent International Publication No. WO94/05881 entitled "A Window, A Door or The Like and in particular A Slide Mounting provided for Same"; all disclose window pivoting and sliding structures.

There is also disclosed by Singapore's Sunday Times on Mar. 14, 1999 a combined sliding and pivot window assembly designed by Mr. Derrick Lee who is awarded a Tan Kah Kee Young Inventor's Silver Award in the Open Category for this design. This type of combined sliding and pivot window assembly is used in most Singapore's Housing Development Board flats. In this type of window assembly, sashes thereof are on the one hand slidable on rails, and on the other hand pivotally openable through an arm system connecting the sashes to the rails. Two major disadvantages are found in this type of combined sliding and pivot window assembly. A first one of the disadvantages is the pivotally opened sashes are still slidable on the rails under strong wind and would very possibly collide with one another and break. Another disadvantage is, when all the sashes are slid to one side of the outer window frame, the arm system of one sash would obstruct the pivotal open of another adjacent sash. Moreover, none of the above-mentioned conventional window assemblies allow all the sash support frames mounted within one outer window frame to be pushed to one side of the outer window frame and then be pivotally opened at the same time.

It is therefore tried by the inventor to develop an improved combined sliding and pivot window assembly to eliminate the disadvantages existing in the conventional combined sliding and pivot window assemblies.

SUMMARY OF THE INVENTION

A primary object of the present invention is to provide a combined sliding and pivot window assembly that includes a plurality of sashes separately and pivotally mounted on sash support frames of which each is a substantially C-shaped member and may separately slide on rails in an outer window frame.

Another object of the present invention is to provide a combined sliding and pivot window assembly that includes combined sliding and locking mechanisms separately mounted on a plurality of sash support frames, such that when sashes mounted on the sash support frames are pivotally opened, the sash support frames are locked to the rails without the risk of sliding to collide with one another.

A further object of the present invention is to provide a combined sliding and pivot window assembly that includes pivot mechanisms allowing sashes to be pivotally opened and stably stay at any desired open position.

A still further object of the present invention is to provide a combined sliding and pivot window assembly that includes sash support frames each of which being a substantially C-shaped member and therefore allows all sashes thereof to slide along with their respective sash support frames to one side of the outer window frame, and then be pivotally opened at the same time.

A still further object of the present invention is to provide a combined sliding and pivot window assembly that includes elastic two-end locking mechanisms to easily lock the sashes at upper and lower ends to their respective sash support frames simply by laterally shifting an external adjusting key.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

Figure 1:
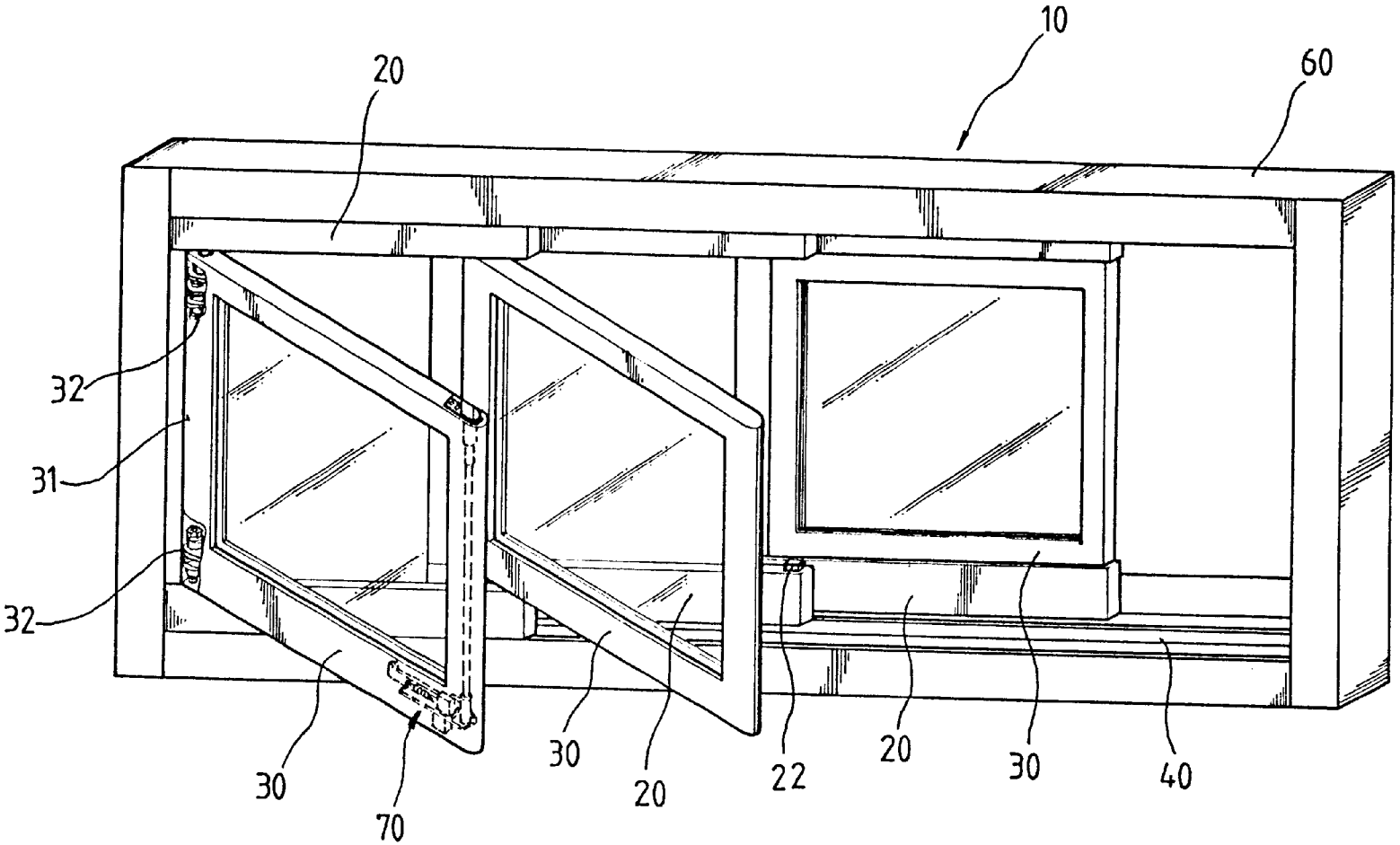
FIG. 1 is a perspective of a combined sliding and pivot window assembly according to a preferred embodiment of the present invention.
Figure 2:
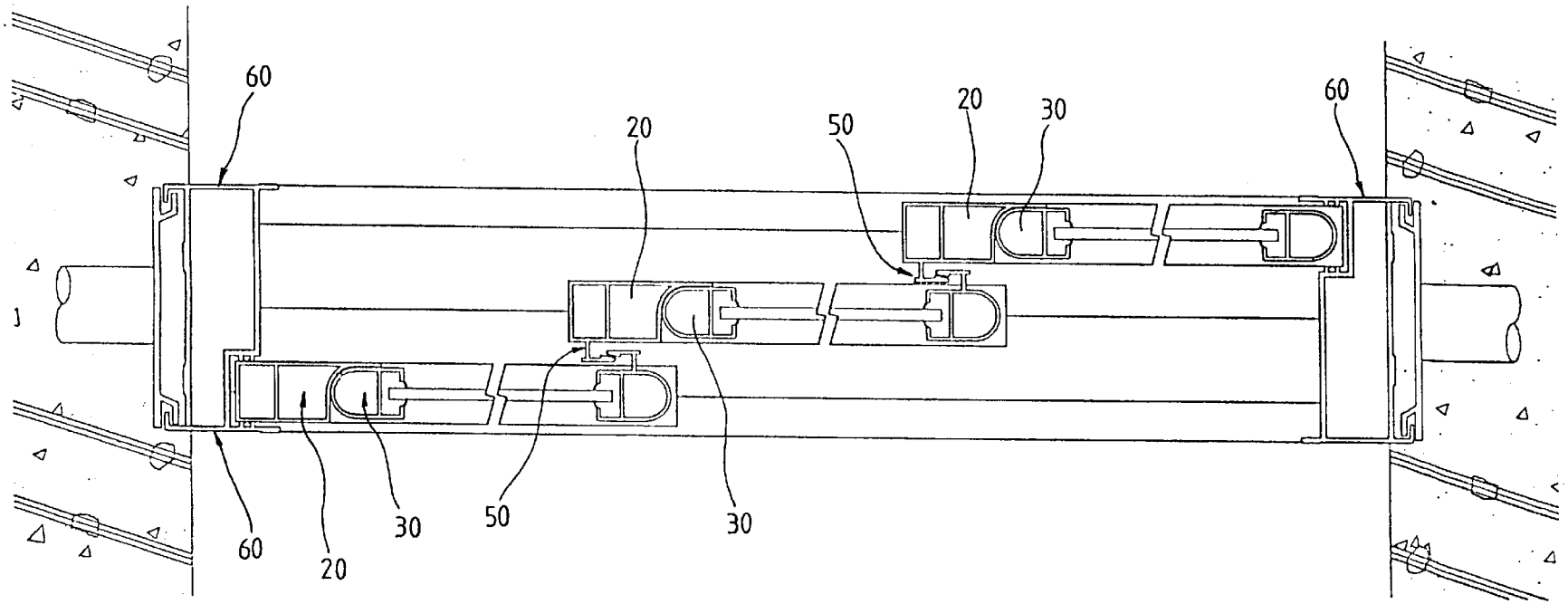
FIG. 2 is a top sectional view of the combined sliding and pivot window assembly of FIG. 1 with all sashes and sash support frames thereof in a fully closed position.
Figure 3:
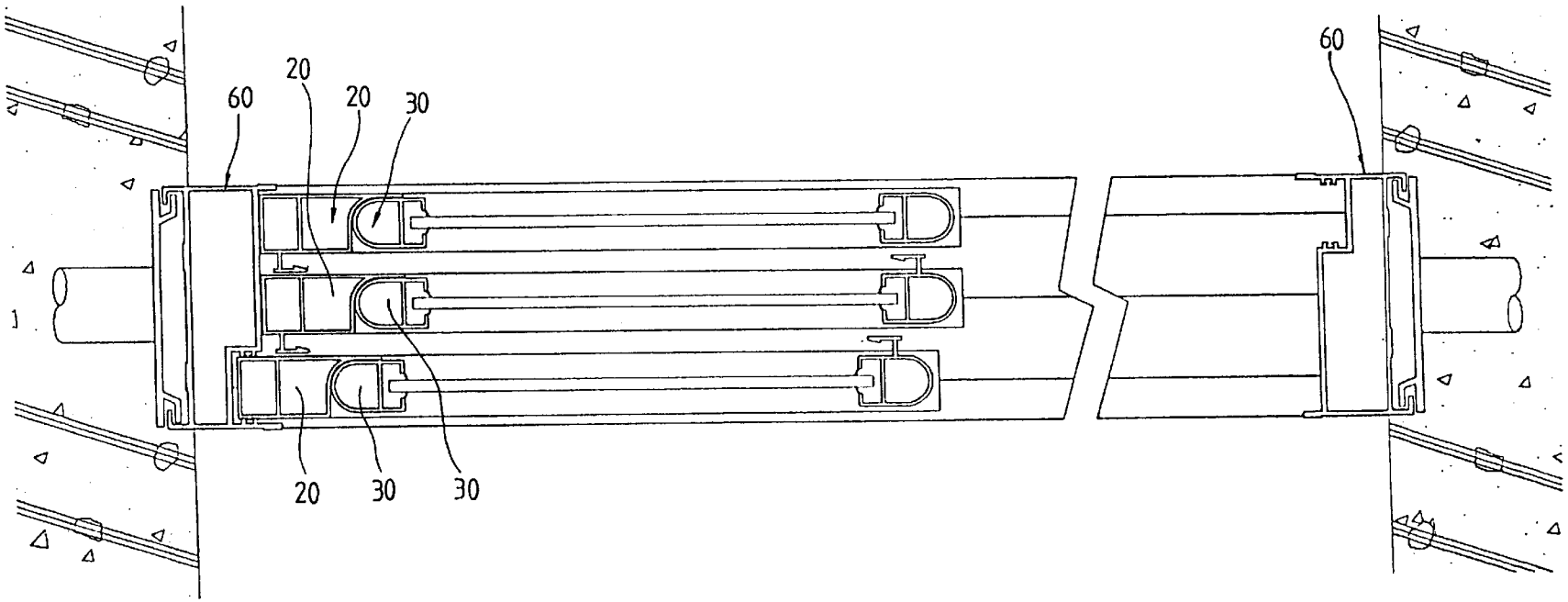
FIG. 3 is still atop sectional view of the combined sliding and pivot window assembly of FIG. 1 with all sashes and sash support frames thereof being pushed to the same side of an outer window frame thereof.
Figure 4:
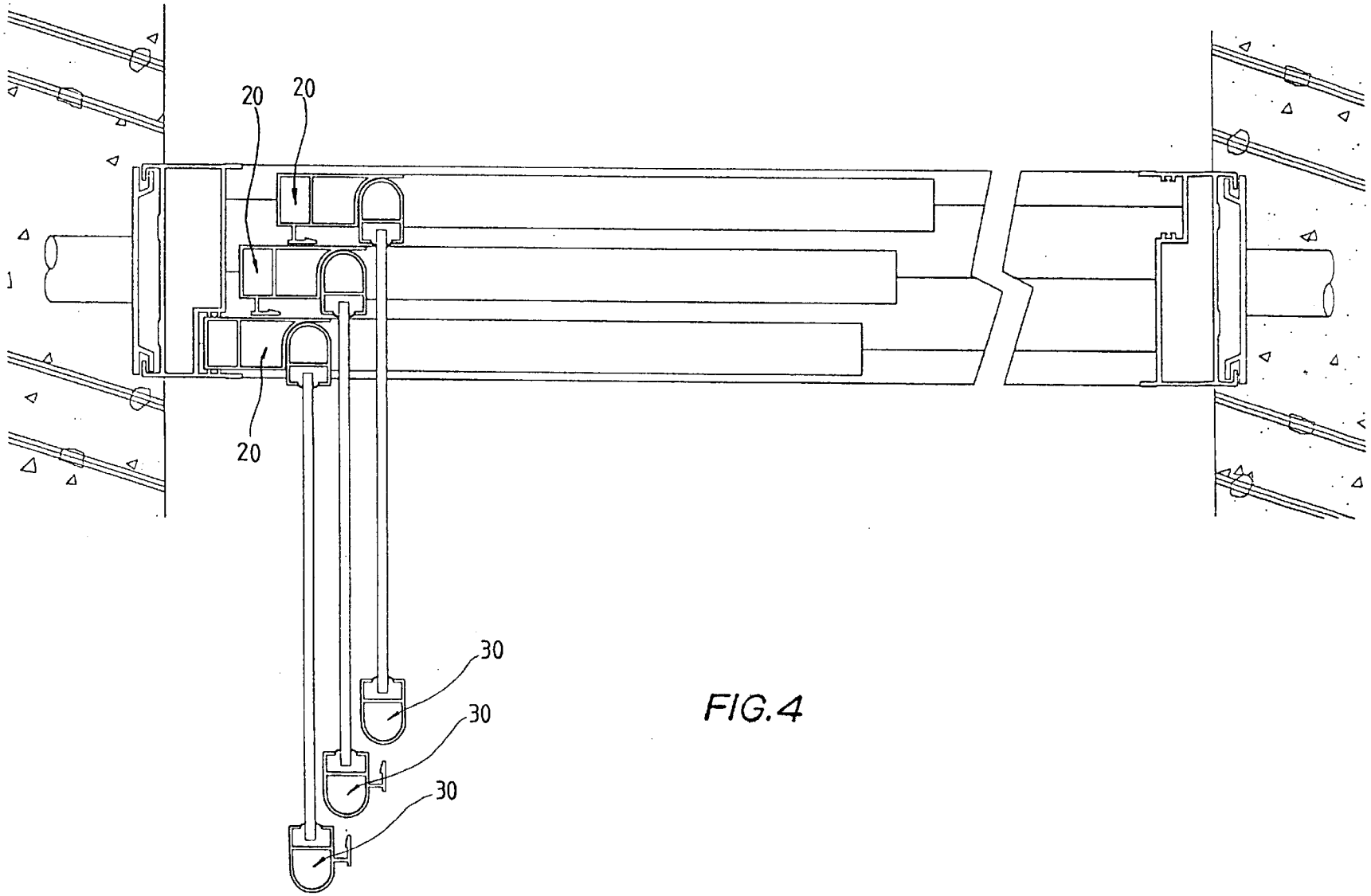
FIG. 4 is still a top sectional view of the combined sliding and pivot window assembly of FIG. 1 with all sashes and sash support frames thereof being pushed to the same side of the outer window frame and pivotally opened.
Figure 5:
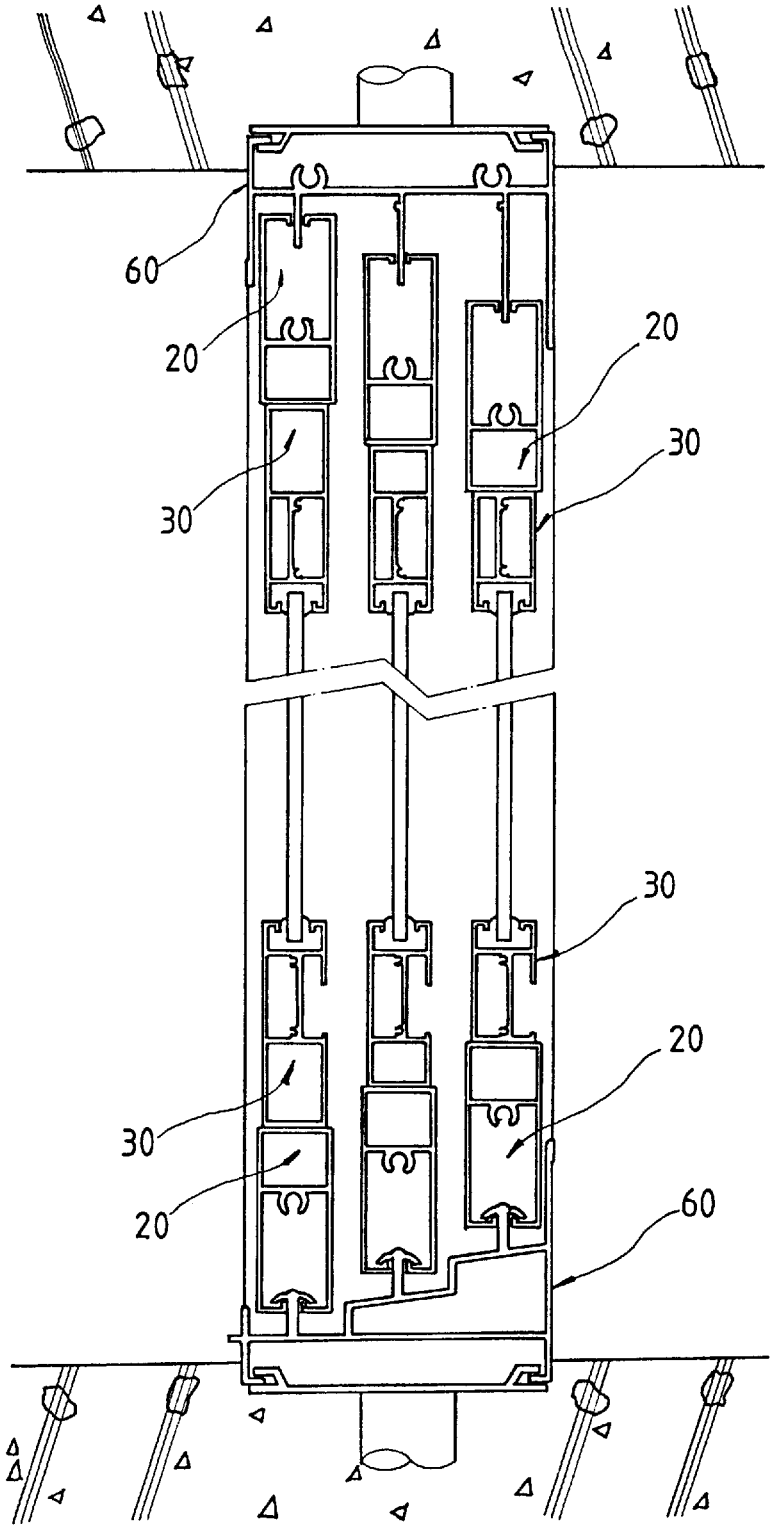
FIG. 5 is a side sectional view of the combined sliding and pivot window assembly of FIG. 1.

DETAILED DESCRIPTION OF THE PREFERRED EMBODIMENTS please refer to FIG. 1 that is an assembled perspective of a combined sliding and pivot window assembly 10 according to a preferred embodiment of the present invention. The combined sliding and pivot window assembly 10 mainly includes a plurality of sashes 30 separately pivotally mounted on corresponding sash support frames 20 which are then slidably mounted on an outer window frame 60, as can be clearly seen from FIG. 5. The sash support frame 20 each is a substantially C-shaped member. That is, unlike most conventional sash support frame that each is a closed rectangular or square member, the sash support frame 20 adopted in the present invention each is a substantially C-shaped member with two horizontal frames and only one single vertical frame at one lateral side of the sash support frame 20. When all the sashes 30 are in a closed position on the sash support frames 20, a combined sliding and locking mechanism 22 provided on each of the sash support frames 20 allows the latter to freely slide along T-shaped rails 40 on the outer window frame 60 to positions as shown in FIG. 2 or 3. Each of the sashes 30 is also provided in one of their vertical members 31 at upper and lower ends thereof with two sets of pivot mechanism 32. After the sashes have been pivotally opened through the pivot mechanisms 32, the sash support frames 20 may be locked on the rail 40 by the combined sliding and locking mechanisms 22 without the risk of moving any further, as shown in FIG. 4. Further, since the sash support frames 20 are substantially C-shaped members, they could all be pushed to one side within the outer window frame 60 and allow all the sashes 30 to be pivotally and outward opened at the same time, so that the outer window frame 60 is in a fully opened state, which forms a unique feature of the window assembly 10 of the present invention.

Figure 6:
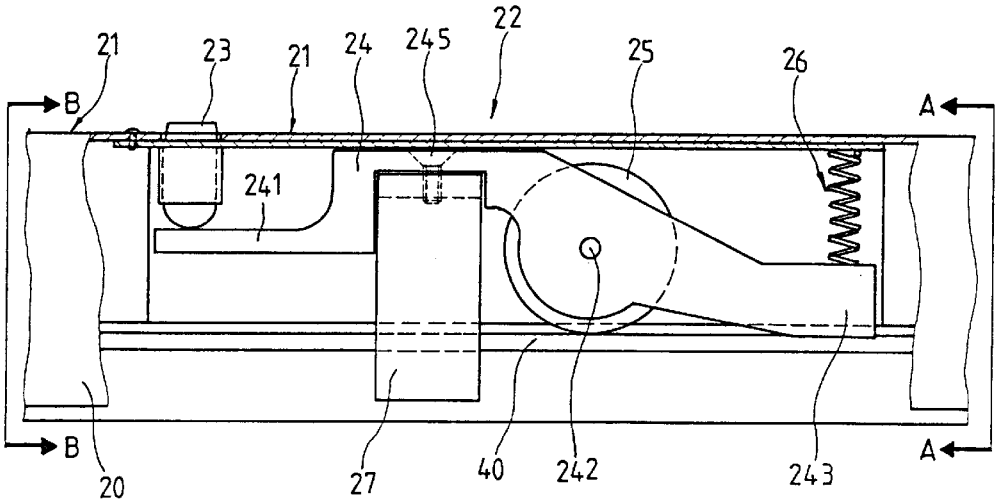
FIG. 6 is a front view of a combined sliding and locking mechanism of the present invention with the corresponding sash in a pivotally opened position.
Figure 7:
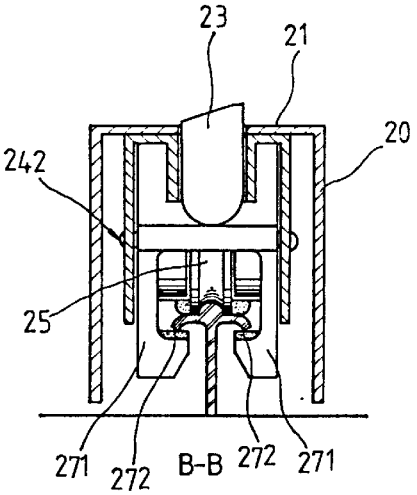
FIG. 7 is a side sectional view taken on line B—B of FIG. 6.
Figure 8:
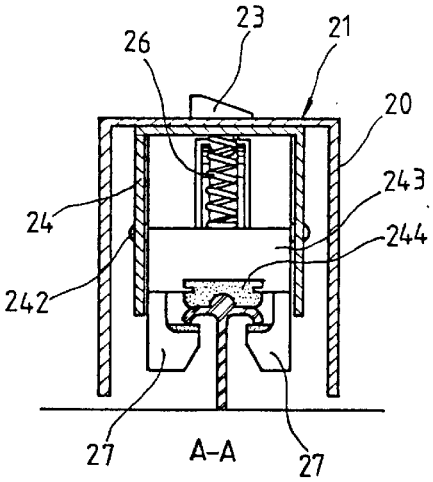
FIG. 8 is a side sectional view taken on line A—A of FIG. 6.

As illustrated in FIG. 2, when the sashes 30 and the sash support frames 20 all are in a fully closed position in the outer window frame 60, two catches 50 or other functionally similar fastening means separately provided on vertical members of two adjacent sashes 30 may, on the one hand, ensure the sashes 30 have been slid to a most suitable position when they are in the closed position, and, on the other hand, enhance the airtight and sound-insulation condition of the sashes 30.

please refer to FIGS. 6, 7 and 8 at the same time. The combined sliding and locking mechanism 22 each is mounted in a lower horizontal member of the sash support frame 20 and mainly includes a guide block 23 having a beveled top normally elastically projected from a top surface 21 of the lower horizontal member of the sash support frame 20. The guide block 23 has a spherical bottom to press against a rear upper surface 241 of a lever plate 24. The lever plate 24 extends a predetermined length in the direction of the lower member of the sash support frame 20. A rotating shaft 242 is provided within a middle section of the lever plate 24 for a pulley 25 to mount thereon, such that the pulley 25 rotatably slides on the rail 40 and serves as a fulcrum in the lever motion of the lever plate 24, so that descending of the rear end 241 of the lever plate 24 by the guide block 23 causes ascending of a front end 243 of the lever plate 24. A return spring 26 is provided above the front end 243 of the lever plate 24 to normally depress the front end 243 of the lever plate 24. The rotating shaft 242 of the lever plate 24 has a substantially n-shaped cross section to hold a rubber stopper 244 thereto. When the front end 243 of the lever plate 24 is in a descendant position, the rubber stopper 244 would press against a top surface of the T-shaped rail 40. An n-shaped member 27 is fixed by a flat-headed screw 245 to the middle section of the lever plate 24 behind the pulley 25 for producing a secondary frictional force. The n-shaped member 27 includes two symmetrical and generally L-shaped leg portions 271 having rubber stoppers 272 provided at lower inner ends thereof. The leg portions 271 downward extend from the lever plate 24 to end at positions below two lower edges of the T-shaped rail 40, such that the rubber stoppers 272 contact with the two lower edges of the rail 40.

When the sash 30 is pivotally turned toward exterior (or interior, depending on the design) to an open position, a lower horizontal member thereof leaves the top surface 21 of the lower horizontal member of the sash support frame 20. At this point, due to the return spring 26 that normally presses the front end 243 of the lever plate 24 downward, the guide block 23 at the rear end 241 is allowed to freely project upward from the top surface 21, as shown in FIGS. 6, 7 and 8, and the rubber stoppers 244 and 272 are brought to forcefully and frictionally press against the top and the lower edges of the T-shaped rail 40, respectively. This makes the sash support frame 20 be frictionally locked to the rail 40 without sliding any further on the rail 40. That is, the pivotally opened sashes 30, as shown in FIG. 4, would not collide with one another and become damaged due to sliding of the sash support frames 20 on the rails 40.

Figure 9:
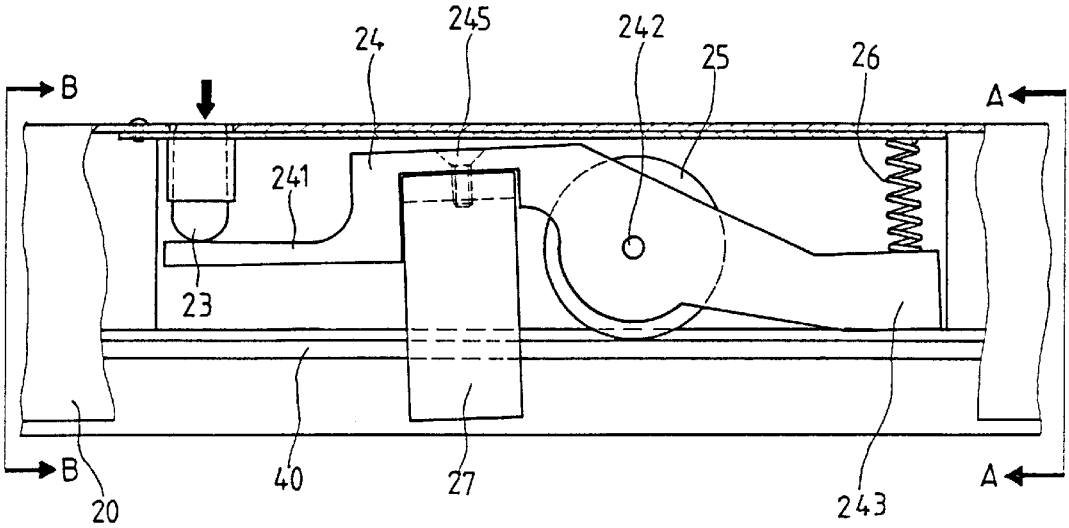
FIG. 9 is another front view of the combined sliding and locking mechanism of the present invention with the corresponding sash in a closed position.
Figure 10:
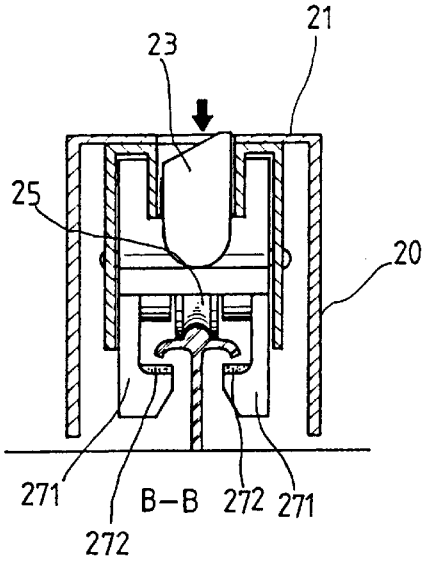
FIG. 10 is a side sectional view taken on line B—B of FIG. 9.
Figure 11:
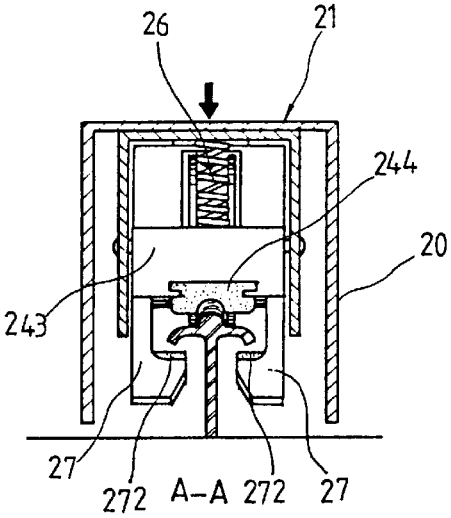
FIG. 11 is a side sectional view taken on line A—A of FIG. 9.

On the other hand, when the sashes 30 are in the closed position, as shown in FIG. 2, the lower horizontal member of each sash 30 is located immediately above the top surface 21 of the lower horizontal member of the sash support frame 20 and pushes the guide block 23 downward into the top surface 21, as shown in FIGS. 9, 10 and 11. The downward moved guide block 23 pushes the rear end 241 of the lever plate 24 down and brings the n-shaped member 27 to a lowered position, causing the rubber stopper 272 to separate from the lower edges of the T-shaped rail 40. Meanwhile, the downward moved guide block 23 causes the lever plate 24 to turn about the rotating shaft 242 in a lever movement to raise the front end 243, bringing the rubber stopper 244 to move upward and separate from the top of the rail 40. At this point, the rubber stoppers 244 and 272 no longer frictionally contact with the rail 40 to lock the sash support frame 20 to the rail 40, allowing the sash support frame 20 to carry the sash 30 to freely slide on the rail 40 within the outer window frame 60. The return spring 26 is now in a compressed condition and accumulates stronger restoring force.

Figure 12:
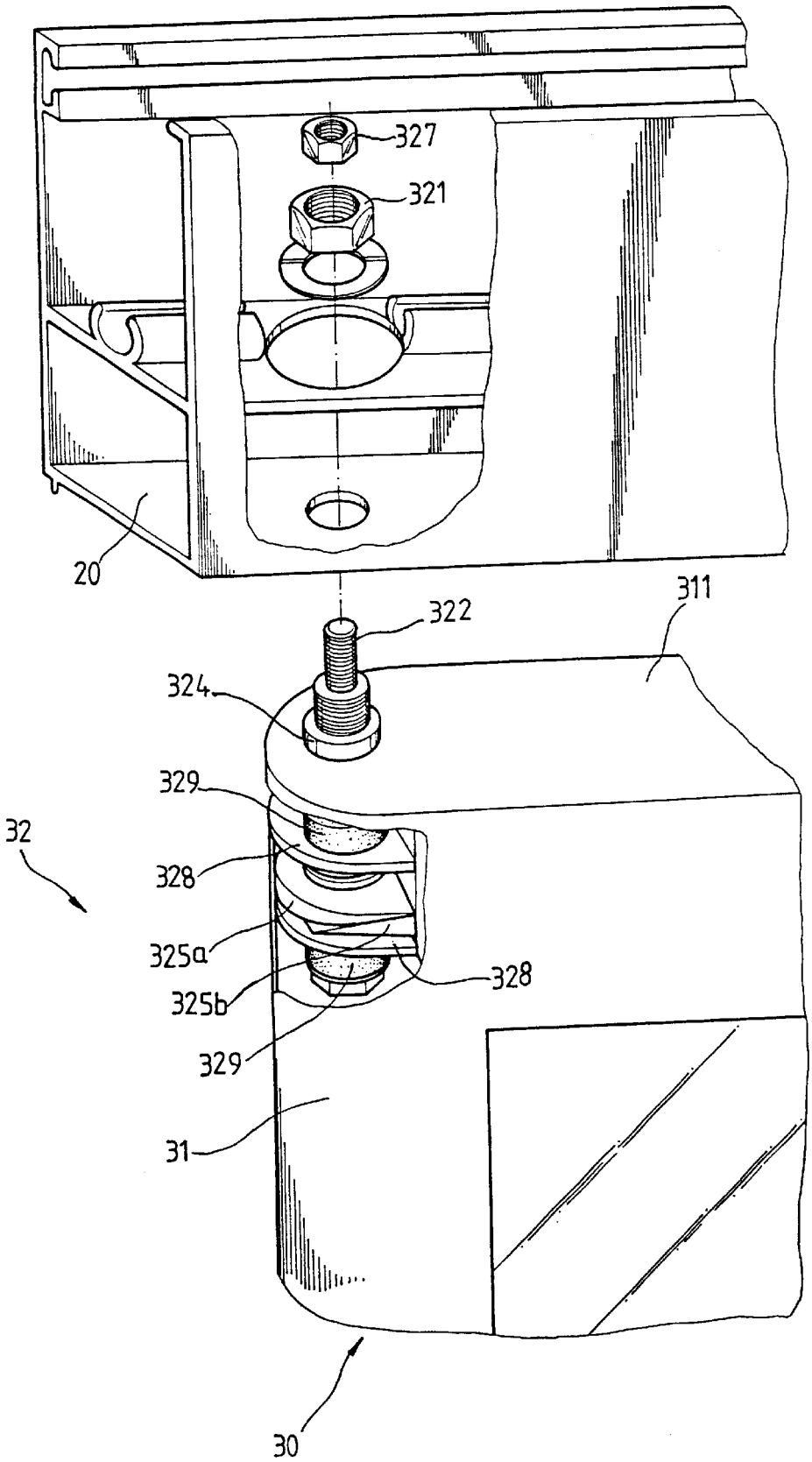
FIG. 12 is an assembled perspective of a pivot mechanism of the present invention.
Figure 13:
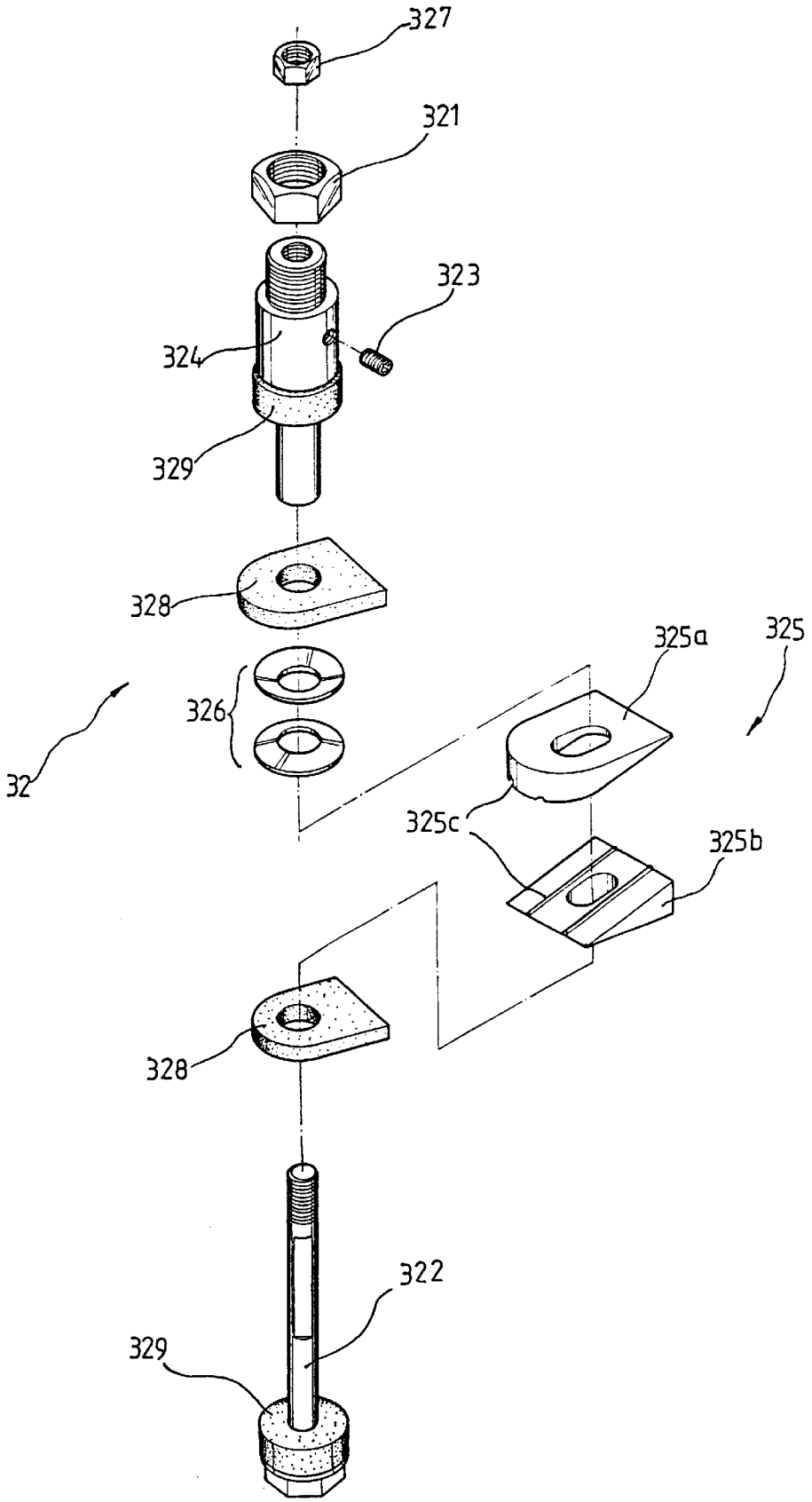
FIG. 13 is an exploded perspective of the pivot mechanism of FIG. 12.

When any one of the sashes 30 is pivotally opened again to leave the sash support frame 20, the guide block 23 in the lower horizontal member of the corresponding sash support frame 20 is released and the restoring force of the compressed return spring 26 pushes the front end 243 of the lever plate 24 downward, bringing the combined sliding and locking mechanism 22 back to the locked state shown in FIGS. 6, 7 and 8.

please now refer to FIGS. 12 and 13 for the detailed structure of the pivot mechanism 32 of the present invention. As can be seen from FIG. 1, two sets of pivot mechanism 32 are separately mounted in one vertical member 31 of the sash 30 at upper and lower ends thereof. The following description is based on the one pivot mechanism 32 mounted in the upper end of the vertical member 31. The pivot mechanism 32 mainly includes a pivot shaft 324, an upper end of which upward projects from a top surface 311 of the vertical member 31 and then extends into an upper horizontal member of the sash support frame 20. A nut 321 is screwed onto the upper end of the pivot shaft 324 to secure the latter to the sash support frame 20, so that the pivot shaft 324 would not rotate relative to the sash support frame 20. A rotation-control means 325 is mounted about the pivot shaft 324 at a lower part thereof to locate in the vertical member 31. The rotation-control means 325 consists of an upper and a lower wedges 325*a* and 325*b*. The upper wedge 325*a* has a cross section corresponding to that of the vertical member 31. Mating grooves and ribs 325*c* may be separately provided on the upper and the lower wedges 325*a* , 325*b* at their inclined surfaces that abut on each other, so that the two wedges 325*a*, 325*b* are guided by the engaged grooves and ribs 325*c* to slide outward relative to one another in opposite directions when a pressure is applied on them. Whereby, when the two wedges 325*a*, 325*b* are subject to a force applied on them and slide outward relative to one another, the rotation-control means 325 formed from the two wedges 325*a*, 325*b* is brought to tightly contact its outer periphery with inner wall of the vertical member 31 and can therefore rotate along with the sash 30 when the same is pivotally opened or closed. Two frictional washers 328 are separately disposed above and below the rotation-control means 325, and elastic packing rings 326 may be further disposed between the frictional washers 328 and the rotation-control means 325. A sub-assembly of the frictional washers 328, the elastic packing rings 326, and the upper and lower wedges 325*a*, 325*b* rotates along with the sash 30. A long bolt 322 is extended upward to extend through a central area of the sub-assembly of the frictional washers 328, the elastic packing rings 326, and the upper and lower wedges 325*a*, 325*b* before being extended through and secured to the pivot shaft 324 by an adjusting nut 327 screwed onto an upper end of the long bolt 322 projected from the upper end of the pivot shaft 324. Moreover, two frictional rings 329 are separately mounted around the lower part of the pivot shaft 324 and the long bolt 322 to locate above and below the two frictional washers 328. Whereby, when the adjusting nut 327 is tightened against the upper end of the long bolt 322, the elastic packing rings 326 are compressed to press the frictional washers 328 against the frictional rings 329 and cause the two members to highly frictionally contact with one another. A magnitude of the frictional force at contact areas between the frictional washers 328 and the frictional rings 329 decides the tightness of the sash 30 relative to the sash support frame 20 when the sash 30 is pivotally turned, and accordingly the possibility for the sash 30 to stably stay at any desired pivotally opened position. To ensure that the pivot shaft 324 and the long bolt 322 are securely associated with one another, a small externally threaded pin 323 may be screwed into the pivot shaft 324 at a predetermined position to firmly press against the long bolt 322.

Figure 14:
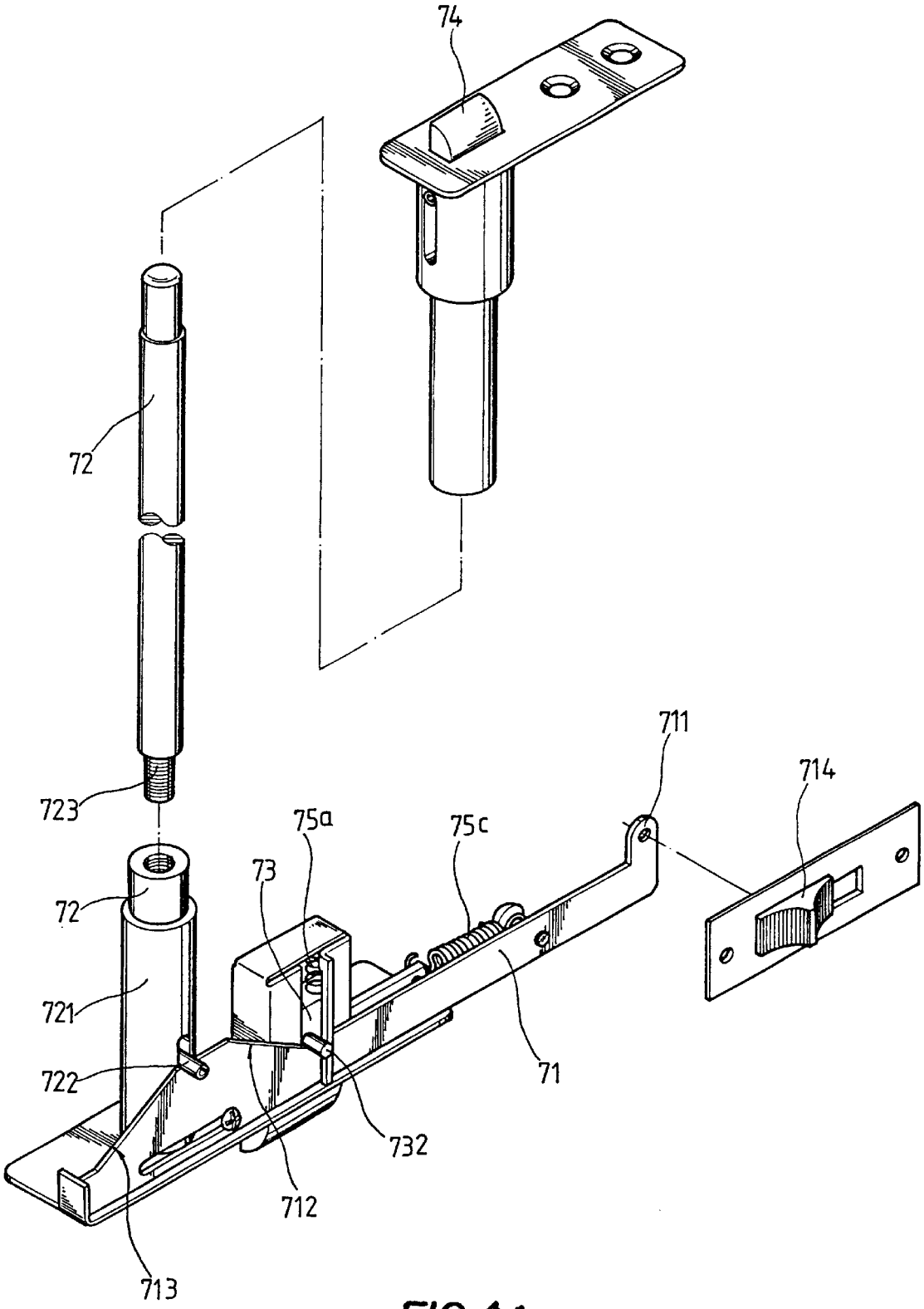
FIG. 14 is an exploded perspective of a two-end locking mechanism for individual sashes of the present invention.
Figure 15:
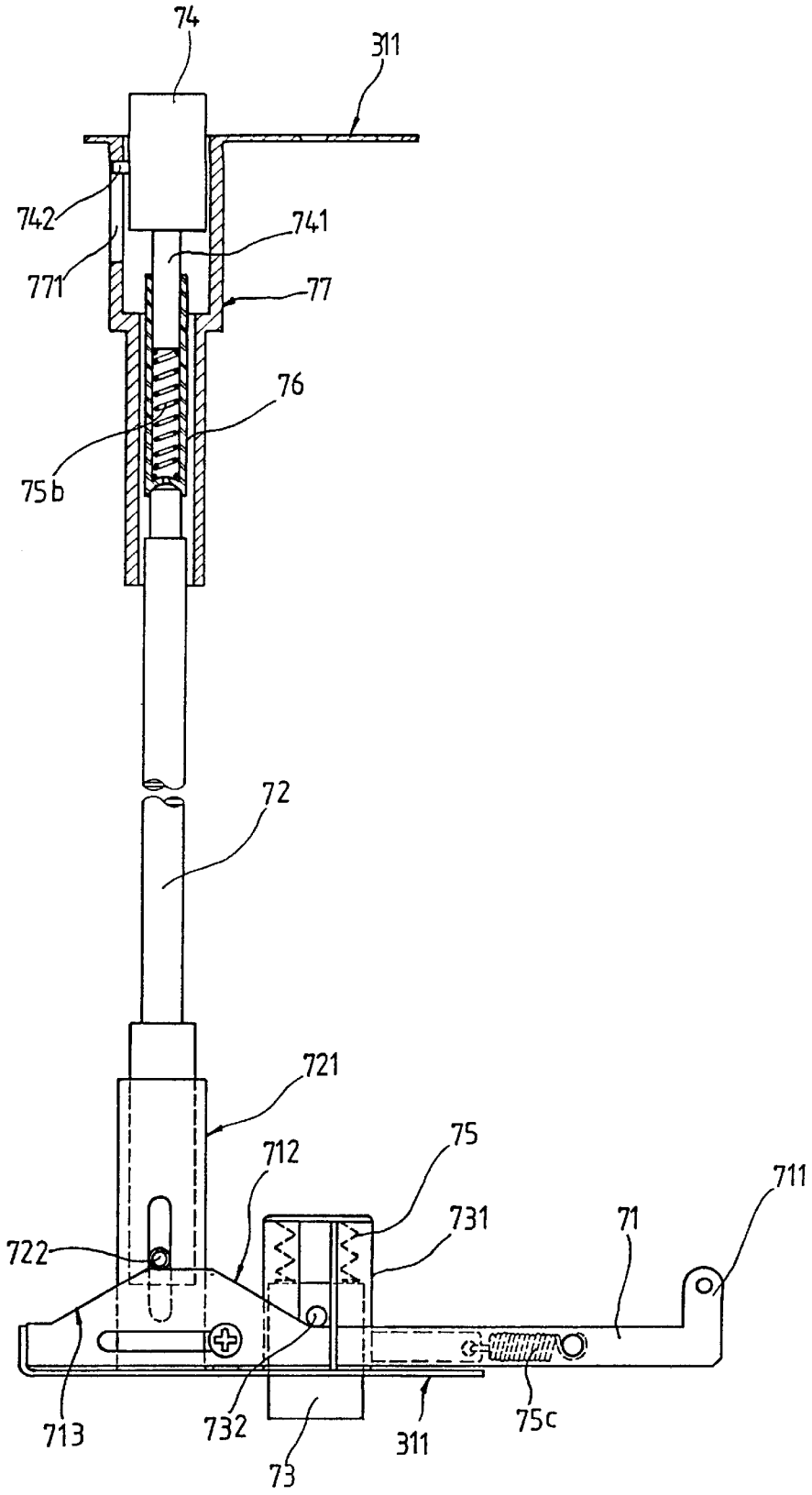
FIG. 15 is a front sectional view of the two-end locking mechanism of FIG. 14 in a locked position.
Figure 16:
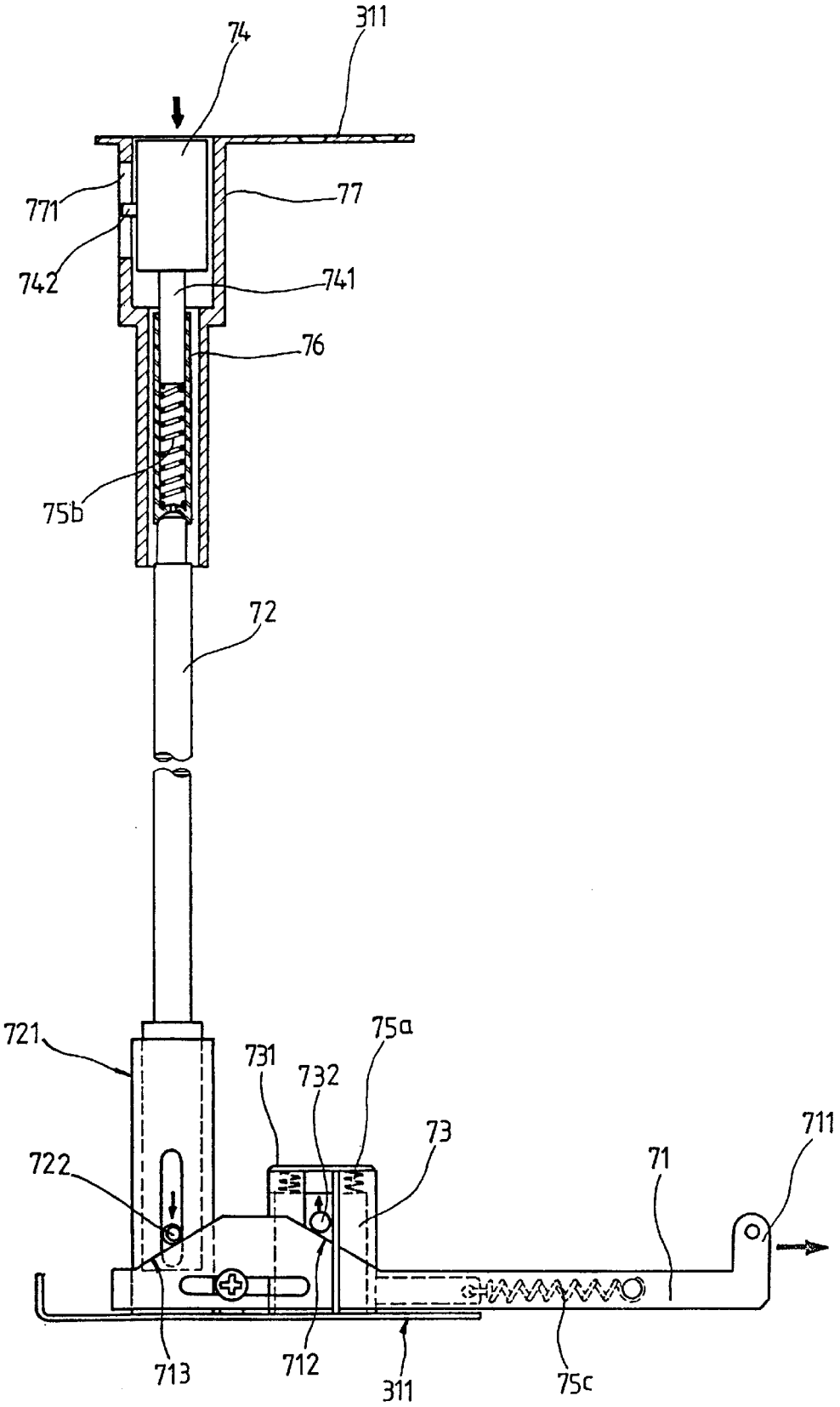
FIG. 16 is another front sectional view of the two-end locking mechanism of FIG. 14 in an unlocked position.

To ensure that the sashes 30 are safely mounted in the sash support frames 20 to sufficiently resist against a wind pressure applied on glass mounted in the sashes 30 and be securely locked to prevent unauthorized open of the sashes 30, an elastic two-end locking mechanism 70 is provided on each of the sashes 30 at one side opposite to the vertical member 31 that has the pivot mechanisms 32 mounted therein. FIGS. 14, 15 and 16 illustrate a preferred embodiment of the elastic two-end locking mechanism 70. As shown, the elastic two-end locking mechanism 70 mainly includes a horizontal pull member 71 and a vertical transmission bar 72. The pull member 71 is connected at a first end 711 to an external adjusting key 714. By shifting the adjusting key 714, the pull member 71 may be laterally moved in the direction of the horizontal members of the sash 30. A second end of the pull member 71 opposite to the first end is formed of a generally trapezoid plate defining a first and a second slopes 712 and 713. Inclinations and heights of the two slopes 712, 713 are decided depending on distances by which a lower and an upper locking key 73 and 74, respectively, are to be moved for locking the sash 30 to the sash support frame 20.

The lower locking key 73 is located in a guide casing 731 provided on the pull member 71 at a suitable position with a pin 732 thereof projected from the guide casing 731 to abut on the first slope 712, such that the pin 732 and accordingly the lower locking key 73 can be guided by the first slope 712 to stably move upward or downward when the pull member 71 is caused to move laterally by shifting the adjusting key 714. A spring 75*a* is provided in the guide casing 731 to normally push the lower locking key 73 downward.

To control the upper locking key 74, a guide tube 721 is vertically provided at the second end of the pull member 71. A lower section of the transmission bar 72 is vertically slidably disposed in the guide tube 721 with a pin 722 projected from the guide tube 721 to abut on the second slope 713, such that the pin 722 and accordingly the transmission bar 72 and the upper locking key 74 connected to an upper end of the transmission bar 72 can be guided by the second slope 713 to stably move upward or downward when the pull member 71 is caused to move laterally by shifting the adjusting key 714. The transmission bar 72 may have an upper sections screwed to the lower section. By screw different length of a thread 723 at a lower end of the upper section into the lower section, different overall length of the transmission bar 72 may be obtained. The upper locking key 74 has an extended lower bar 741 that downward extends into a guide sleeve 76. A spring 75*b* is disposed in the guide sleeve 76 below the extended lower bar 741. Both the upper locking key 74 and the guide sleeve 76 are enclosed in an outer sleeve 77. A pin 742 sideward extends from the upper locking key 74 to vertically move in a guide slot 771 provided on the outer sleeve 77. The upper end of the upper section of the transmission bar 72 upward extends into a lower end of the outer sleeve 77 to abut against the lower end of the guide sleeve 76. Whereby when the pin 722 is guided by the second slope 713 to move upward or downward, the transmission bar 72 is brought to move upward or downward and thereby compress or release the spring 75*b*, causing the upper locking key 74 to project from or retract into the upper horizontal member of the sash 30.

When the sash 30 is pivotally turned to the closed position in the sash support frame 20, both the lower and the upper locking keys 73, 74 are initially pushed by the sash support frame 20 into the lower and the upper horizontal members, respectively, of the sash 30, and then pushed by the springs 75*a*, 75*b* to project into a lock hole correspondingly provided on the sash support frame 20 and thereby lock the sash 30 to the sash support frame 20.

And when the sash 30 is to be pivotally turned from the closed position to the open position, a user needs only to move the adjusting key 714 laterally, causing the slopes 712, 713 on the pull member 71 to separately guide the lower and the upper locking keys 73, 74 to move inward to separate from the lock holes provided on the sash support frame 20, allowing the sash 30 to be pivotally opened. And, when the adjusting key 714 is released, the pull member 71 is pushed by a spring 75*c* to its original position.

It is to be understood that the present invention has been described and illustrated in the form of a preferred embodiment thereof. Many changes, modifications and variations could be made to the present invention without departing from the scope and spirit thereof. For example, the slopes 712 and 713 may be of any other suitable shape, the lever plate 24 may be suitably changed in its profile to facilitate convenient manufacture of parts thereof, and the combined sliding and locking mechanisms may be mounted in the sash support frames 20 at differently selected positions. All these changes of the present invention could be easily made by a person skilled in the art and should therefore be included in the scope of the present invention.

What is claimed is:

1. A combined sliding and pivot window assembly, comprising a plurality of sashes, a plurality of substantially C-shaped sash support frames corresponding to that of said sashes to each hold one said sash thereto, an outer window frame within which said sash support frames being fixed, a combined sliding and locking mechanism provided in a lower horizontal member of each of said sash support frames for said sash support frames to either slide or be locked on a rail correspondingly provided on said outer window frame, pivot mechanisms mounted to upper and lower ends of a vertical member of each said sash for said sash to be pivotally turned open or closed relative to said sash support frame holding said sash, and an elastic two-end locking mechanism mounted in another vertical member of each of said sashes for easily locking said sashes to upper and lower horizontal members of said sash support frame corresponding to said sash;

said substantially C-shaped sash support frames, each having two horizontal and two vertical frames to form a closed rectangular or square member, each having two horizontal frames and only one single vertical frame; said C-shaped sash support frames having their open side, that is, a side of said support frames without the vertical frame, all facing toward the same direction, such that when all of said sash support frames are pushed to one side in said outer window frame, said sashes supported by said C-shaped sash support frames could still be pivotally and outward opened;

said combined sliding and locking mechanism each including a guide block having a beveled top normally elastically projected from a top surface of said lower horizontal member of said sash support frame, said guide block also having a spherical bottom to press against a rear upper surface of a lever plate that extends a predetermined length in the direction of said lower horizontal member of said sash support frame; a rotating shaft being provided within a middle section of said lever plate for a pulley to mount thereon, such that said pulley rotatably slides on said rail on which said sash support frame slides and serves as a fulcrum in the lever motion of said lever plate, so that descending of said rear end of said lever plate by said guide block causes ascending of a front end of said lever plate; a return spring being provided above said front end of said lever plate to normally depress said front end of said lever plate; a first rubber stopper being held to said front end of said lever plate, such that when said front end of said lever plate is in a descendant position, said first rubber stopper downward presses against a top surface of said rail; and an n-shaped member being fixed to a middle section of said lever plate behind said pulley, said n-shaped member including two symmetrical and generally L-shaped leg portions having second rubber stoppers provided at lower inner ends thereof to frictionally contact with two lower edges of said rail; whereby when said sash is in a pivotally opened position, said guide block is allowed to freely project upward from said top surface of said lower horizontal member of said sash support frame and brings said second rubber stoppers on said legs of said n-shaped member to forcefully and frictionally press against said rail, locking said sash support frame to said rail without sliding any further on said rail; and said pivot mechanism each including a pivot shaft, an outer end of which projecting from a top or a bottom surface of said vertical member of said sash and then extending into said upper or lower horizontal member of said sash support frame and being secured thereto with a nut, so that said pivot shaft does not rotate relative to said sash support frame; a rotation-control means being fixedly mounted around said pivot shaft at an inner part thereof to locate in said vertical member of said sash, said rotation-control means being disposed between two frictional washers with two frictional rings separately disposed at two outer sides of said two frictional washers; a long bolt being extended through a central area of said frictional washers, said frictional rings, and said rotation-control means before being extended through and secured to said pivot shaft by an adjusting nut screwed onto an outer end of said long bolt projected from said outer end of said pivot shaft; whereby when said adjusting nut is tightened against said outer end of said long bolt, said frictional washers and said frictional rings are highly frictionally contact with one another, allowing said sash to stably stay at any desired pivotally opened position.

2. A combined sliding and pivot window assembly as claimed in claim 1, wherein said rotation-control means consists of an outer and an inner wedges that abut on one another at inclined inner surfaces thereof, said outer wedge having a cross section corresponding to that of said vertical member of said sash, and mating grooves and ribs being separately provided on said outer and said inner wedges at their inclined surfaces that abut on each other, so that said two wedges are guided by said grooves and ribs engaged with one another to slide outward relative to one another in opposite directions when a pressure is applied on said two wedges, causing said two wedges to tightly contact their outer peripheries with inner wall of said vertical member of said sash and can therefore rotate along with said sash when the same is pivotally opened or closed.

3. A combined sliding and pivot window assembly as claimed in claim 1, wherein said rotation-control means and one of said two frictional washers at an outer side of said rotation-control means further have elastic packing rings disposed between them to increase a frictional contacting force therebetween.

4. A combined sliding and pivot window assembly as claimed in claim 1, wherein said elastic two-end locking mechanism each includes a horizontal pull member, a lower locking key, an upper locking key, and a vertical transmission bar;

said pull member being connected at a first end to an external adjusting key for easily laterally moving said pull member through shifting said adjusting key, a second end of said pull member opposite to said first end being formed of a generally trapezoid plate defining a first and a second slopes having inclinations and heights decided depending on distances by which said lower and said upper locking keys are to be moved for locking said sash to said sash support frame;

said lower locking key being located in a guide casing provided on said pull member at a predetermined position with a pin thereof projected from said guide casing to abut on said first slope on said pull member, such that said pin and accordingly said lower locking key are guided by said first slope to stably move upward or downward when said pull member is caused to move laterally by shifting said adjusting key; and a spring being provided in said guide casing to normally push said lower locking key downward;

said upper locking key being located in an outer sleeve with a pin sideward extended from said upper locking key to vertically move in a guide slot provided on said outer sleeve, said upper locking key having an extended lower bar that downward extends into a guide sleeve, a spring being disposed in said guide sleeve below said extended lower bar to normally push said upper locking key upward, and said guide sleeve being enclosed in said outer sleeve; and said transmission bar including a lower section that is vertically slidably received in a guide tube vertically connected to said second end of said pull member with a pin of said lower section projected from said guide tube to abut on said second slope, such that said pin and accordingly said lower section of said transmission bar can be guided by the second slope to stably move upward or downward when said pull member is caused to move laterally by shifting said adjusting key, said transmission bar also including an upper section that may be screwed into said lower section by different depth to provide different overall length of said transmission bar; said upper section of said transmission bar upward extending into a lower end of said outer sleeve to abut against a lower end of said guide sleeve; whereby when said pin projected from said lower section of said transmission is guided by said second slope to move upward or downward, said upper section of said transmission bar is brought to compress or release said spring in said guiding sleeve of said upper locking key, causing said upper locking key to project from or retract into said upper horizontal member of said sash;

whereby when said sash is to be pivotally opened from said sash support frame, a user needs only to shift said adjusting key laterally to cause said first and said second slopes on said pull member to separately guide said lower and said upper locking keys to move into said guiding case and said outer sleeve, respectively, to unlock said sash from said sash support frame.

* * * * *